US009868021B2

(12) United States Patent
Lugton

(10) Patent No.: US 9,868,021 B2
(45) Date of Patent: Jan. 16, 2018

(54) CYCLING ACCESSORY AND METHOD OF USE

(71) Applicant: The Bicycle Corporation Pty. Ltd., Victoria (AU)

(72) Inventor: David Lugton, Victoria (AU)

(73) Assignee: THE BICYCLE CORPORATION PTY LTD, Victoria (AU)

( * ) Notice: Subject to any disclaimer, the term of this patent is extended or adjusted under 35 U.S.C. 154(b) by 490 days.

(21) Appl. No.: 13/866,476

(22) Filed: Apr. 19, 2013

(65) Prior Publication Data

US 2013/0281265 A1 Oct. 24, 2013

(30) Foreign Application Priority Data

Apr. 19, 2012 (AU) ..... 2012901536
May 29, 2012 (AU) ..... 2012902221

(51) Int. Cl.

| | |
|---|---|
| ***A63B 22/02*** | (2006.01) |
| ***A63B 22/06*** | (2006.01) |
| ***A63B 69/16*** | (2006.01) |
| *A63B 21/005* | (2006.01) |
| *A63B 21/015* | (2006.01) |
| *A63B 21/22* | (2006.01) |
| *A63B 24/00* | (2006.01) |

(52) U.S. Cl.

CPC ..... *A63B 22/06* (2013.01); *A63B 22/02* (2013.01); *A63B 69/16* (2013.01); *A63B 21/0051* (2013.01); *A63B 21/015* (2013.01); *A63B 21/225* (2013.01); *A63B 24/0087* (2013.01); *A63B 2069/164* (2013.01); *A63B 2069/168* (2013.01); *A63B 2209/08* (2013.01); *A63B 2225/20* (2013.01); *A63B 2225/50* (2013.01)

(58) Field of Classification Search

CPC ..... A63B 69/0476; A63B 69/69; A63B 2069/161; A63B 2069/164; A63B 2069/166; A63B 2069/167; A63B 2069/168; A63B 22/02; A63B 22/06; A63B 23/0476; A63B 69/16; A63B 21/22; A63B 21/225; A63B 22/0605; A63B 2022/0635

See application file for complete search history.

(56) References Cited

U.S. PATENT DOCUMENTS

| | | | | | |
|---|---|---|---|---|---|
| 554,754 | A * | 2/1896 | Webber | A63B 69/16 | 482/61 |
| 604,200 | A * | 5/1898 | Vogeler | 482/61 | |
| 2,261,846 | A * | 11/1941 | Dollinger | A63B 69/04 | 482/61 |
| 2,623,302 | A * | 12/1952 | Shields | A61B 5/18 | 280/233 |
| 4,415,152 | A * | 11/1983 | Smith | 482/61 | |
| 4,750,737 | A * | 6/1988 | Smith | 482/61 | |
| 5,433,681 | A * | 7/1995 | Minoura | 482/61 | |
| 6,302,826 | B1 * | 10/2001 | Lee | 482/54 | |
| 6,361,477 | B1 * | 3/2002 | Kolda | 482/61 | |

(Continued)

FOREIGN PATENT DOCUMENTS

IT WO 2008099429 A1 * 8/2008 ..... A63B 22/02

*Primary Examiner* — Nyca T Nguyen
(74) *Attorney, Agent, or Firm* — Sughrue Mion, PLLC

(57) ABSTRACT

A bicycle trainer, the bicycle trainer including a biased, pivot mounted belt for contact with the rear wheel of a bicycle, such that the belt moves in response to rotation of the wheel and applies predetermined tension.

18 Claims, 9 Drawing Sheets

(56) References Cited

U.S. PATENT DOCUMENTS

| | | | | |
|---|---|---|---|---|
| 7,220,219 | B2 * | 5/2007 | Papadopoulos et al. | 482/57 |
| 2001/0051564 | A1 * | 12/2001 | Iund | A63B 22/0023 482/54 |
| 2003/0027692 | A1 * | 2/2003 | Phillips | 482/57 |
| 2004/0063549 | A1 * | 4/2004 | Kuo | A63B 22/0242 482/54 |
| 2004/0072657 | A1 * | 4/2004 | Arguilez | 482/61 |
| 2004/0077465 | A1 * | 4/2004 | Schmidt | 482/57 |
| 2004/0192514 | A1 * | 9/2004 | Piaget | A63B 22/0292 482/54 |
| 2004/0198562 | A1 * | 10/2004 | Greenleaf | 482/61 |
| 2008/0188358 | A1 * | 8/2008 | Kuo | A63B 22/0235 482/54 |
| 2010/0317493 | A1 * | 12/2010 | Chen | 482/61 |
| 2011/0124466 | A1 * | 5/2011 | Nishimura | A63B 22/0235 482/4 |

* cited by examiner

CYCLING ACCESSORY AND METHOD OF USE

FIELD OF INVENTION

The present invention relates to the field of sporting accessories.

In one form, the invention relates to an accessory for a bicycle.

In one particular aspect the present invention is suitable for use in a method of training or practice for cyclists.

BACKGROUND ART

It is to be appreciated that any discussion of documents, devices, acts or knowledge in this specification is included to explain the context of the present invention. Further, the discussion throughout this specification comes about due to the realisation of the inventor and/or the identification of certain related art problems by the inventor. Moreover, any discussion of material such as documents, devices, acts or knowledge in this specification is included to explain the context of the invention in terms of the inventor's knowledge and experience and, accordingly, any such discussion should not be taken as an admission that any of the material forms part of the prior art base or the common general knowledge in the relevant art in Australia, or elsewhere, on or before the priority date of the disclosure and claims herein.

A bicycle trainer is a piece of equipment for riding a bicycle while it remains stationary. Bicycle trainers permit practice of cycling skills.

This is useful for cyclists to train—particularly when riding conditions are poor if they are carrying an injury. It also allows the cyclist to perform other activities such as watching TV, and avoids the need to concentrate on road conditions or obstacles.

One of the oldest types of bicycle trainers comprises three rollers (two for the rear wheel and one for the front), on top of which the bicycle rides. A belt connects one of the rear rollers to the front roller, causing the front wheel of the bicycle to spin when the bicycle is pedaled. The spacing of bicycle rollers can usually be adjusted to match the bicycle's wheelbase with the front roller located slightly ahead of the hub of the front wheel. Because balance is required to keep the bicycle on the rollers they are often used by bicycle racers to finely tune their balance, which is an important skill for drafting and peloton riding. However, often cyclists do not need or want to practice this skill prefer the more stable bicycle trainers.

A bicycle trainer consists of a frame, a clamp to hold the bicycle securely, a roller that presses up against the rear wheel, and a mechanism that provides resistance when the pedals are turned. Trainers require better technique and better body position than stationary bicycles, while providing a more realistic feeling. Some trainers are equipped with sensors that monitor various ride parameters such as power output, cadence, virtual speed and heart rate. Measuring these parameters can help to fine-tune the athlete's training.

In a wind trainer, the cyclist's leg power drives fan blades that create air resistance which is transmitted to the rear tire. Resistance increases with the cyclist's speed. However, there is an upper limit to the resistance and wind trainers are relatively noisy.

Magnetic bicycle trainers have magnets that resist each other and a magnetic flywheel creates the resistance on the rear wheel—some with handlebar-mounted control boxes for changing the level of resistance during a training session. While these trainers are nearly silent in operation, the resistance has an upper limit and they are prone to breaking.

Fluid bicycle trainers combine a magnetic flywheel with liquid-filled chambers to create resistance. They are nearly silent with the advantage of adding progressive resistance. However, repeated friction, heating and consequential expansion and contraction of the fluid tends to cause the seals to leak.

A small number of trainers use a centrifugal pressure mechanism to create resistance, the pressure mechanism comprising pressure plates, ball bearings and specially shaped grooves. These are nearly silent and resistance curves may be adjusted by the user.

More recently virtual reality trainers have been used to create a very comprehensive simulator. Virtual reality simulators allow the rear wheel to sit on a motorized roller while the front fork fits in a frame equipped with steering sensors, the whole system being linked to a computer with 'virtual world' software. The riders steers through as virtual world and pedaling gets harder (the motorized roller 'loads' the rear wheel) when going uphill. The sophistication of the computer system allows it to be linked to the internet to provide additional information. While this type of trainer provides abundant mental stimulation, the computer hardware and software is expensive and requires extensive computer hardware.

Usually all trainers can be adjusted for most sizes of road and mountain bikes. However, the knobby tires typically used on mountain bikes cause vibration and noise, defeating the purpose of noiseless units. Furthermore, trainers which use rollers to contact the rear wheel of a bicycle tend to impart excessive load on the wheel axle with concomitant heating and uneven wear on the tyre. Uneven tyre wear tends to put the trainer out of balance, with concomitant bearing damage as the load comes off the spokes. As a result the trainer starts to move, increasing noise and wear on the bearings, tyre, hub and spokes. The debrading of rubber and distortion of tyre shape is a particular problem for racing tyres, which often end up with a square cross section instead of curved.

SUMMARY OF INVENTION

An object of the present invention is to provide a bicycle trainer that imparts less wear and tear on the bicycle, particularly the rear wheel.

A further object of the present invention is to provide a bicycle trainer that can be used for a range of different bicycles and different bicycle wheels.

It is an object of the embodiments described herein to overcome or alleviate at least one of the above noted drawbacks of related art systems or to at least provide a useful alternative to related art systems.

In a first aspect of embodiments described herein there is provided a bicycle trainer, the bicycle trainer comprising a biased, pivot mounted belt for contact with the rear wheel of a bicycle, such that the belt moves in response to rotation of the wheel and applies predetermined tension.

In a preferred embodiment the predetermined tension is substantially constant. Furthermore the predetermined tension may be changed or otherwise controlled. In a particularly preferred embodiment the predetermined tension may be set without the need for a secondary tensioning device.

The bicycle trainer is preferably removably attached to a stand. Typically the stand has struts configured to support a spindle which can be passed through the hub of the rear wheel of a bicycle, suspending the rear wheel free of the ground. The device may be mounted on the stand by any convenient means such as a quick release mechanism or by an interlocking conformation of corresponding parts of the bicycle trainer and the stand. Alternatively the device may be permanently attached to a stand, for example, by welding.

Preferably the belt is a continuous band of material looped around at least two rollers, with the rear wheel contacting the belt intermediate the rollers. The rollers are typically mounted between a pair of arms which have a common pivot point. In one preferred embodiment the pair of arms are mounted on a pinion providing a common pivot point at their fulcrum. Preferably, the belt is comprised of flexible material that at least partially conforms to the cross-sectional profile of the rear wheel to spread out the force and wear on the tyre. Preferably, the material flexibility will also accommodate the profile of knobby tyres. The device of the present invention is sufficiently simple that it can be set up square on to the tyre, avoiding run-out of the belt.

In a particularly preferred embodiment the bias is a spring, mechanism, or weight providing tension to the pivot mounted belt. For example, the belt may be pivotally attached to a mounting bracket used to mount the device on a stand. The bias provides the advantage of constant belt tension so that the wheel is never overloaded irrespective of variations in pressure and contact between the tyre and belt. Furthermore, the movability of the belt about the pivot allows automatic adjustment to wheel characteristics—such as wheel diameter, tyre width, tread design—which vary from racing bicycles, to touring bicycles, to hybrid bicycles, to mountain bicycles and every other type of bicycle. While some devices of the prior art include belt drives, such as those from xtreme® having magnetic belt drives, these prior art devices require manual adjustment for each new wheel and do not automatically adjust.

Typically the bicycle trainer will include a resistance means that allows for controlling resistance of the belt to movement of the rear wheel. For example, the resistance means may be used to pre-set the belt to a desired resistance level prior to commencing exercise. Alternatively or in addition, the resistance may be altered during exercise. The resistance means may comprise any suitable device such as a clutch or drum brake or magnetic resistance could be used. In one preferred embodiment the belt passes around a roller which has a resistance set or controlled by a cable operated drum brake. Control or actuation of the resistance level imparted by the resistance means may be achieved by any convenient means such as a cable.

Typically the pivot will be biased by a spring, such as a coil spring. Alternatively the biasing can be provided by any suitable means such as a piston or pneumatic device or a weight. For example, the weight may comprise the resistance means, magneto or flywheel. In one preferred embodiment, the pivot comprises a pinion mounted at the fulcrum between a pair of arms which support rollers and the belt. A magneto or flywheel located at one end of the pair of arms provides sufficient biasing weight to rotate the arms in a first direction about the fulcrum. Applying a wheel to the belt counters the biasing weight and rotates the arms in a second direction about the fulcrum. Thus, the tension on the belt is at least in part a function of pressure due to the wheel and the opposing bias due to the weight.

Preferably the bicycle trainer includes means for increasing tension on the belt by applying a stretching force. For example, an outward force may be applied to the belt in proportion to increased pressure applied by the wheel. In a preferred embodiment, the belt passes around rollers supported between pivot arms. As increased pressure is applied by the wheel to the belt, the pivot arms pivot relative to one or more components having a fixed position and which impinge on the belt and stretch it outwards. Preferably the fixed position component is a shaft or roller that resides within through an appropriately shaped recess in the pivot arms. Thus, a constant belt tension is maintained and the wheel is never overloaded irrespective of variations in pressure and contact between the tyre and belt.

In an alternative embodiment a non-stretch belt is used and the predetermined tension is principally determined by the distance between the rollers. In a particularly preferred embodiment the predetermined tension may be set without the need for a secondary tensioning device.

In a particularly preferred embodiment of the present invention, at least one roller is an adjustable eccentric roller, that is, although the roller is circular in cross-section, the position of the shaft can be adjusted by a fixing screw (or other fixing means) that is not located at the geometric centre. This means that the distance between the rollers and the tension on the rollers can be finely controlled and set by adjustment of the fixing screw.

The ability to readily change the predetermined tension between the rollers in this manner is also important because it allows ready loading and unloading of the belt from the bicycle trainer for servicing of the bicycle trainer. The manufacture and subsequent servicing are further facilitated by arranging the components so that they can be assembled and disassembled in a top-down manner. Specifically, the bicycle trainer can be placed on its side and each component can be systematically put in place or removed from above, without the need to access the assembly from another angle.

In a second aspect of embodiments described herein there is provided a bicycle trainer, the bicycle trainer comprising a biased, pivot mounted belt for contact with the rear wheel of a bicycle, such that the belt moves in response to rotation of the wheel and applies substantially constant tension and a resistance means for controlling resistance of the belt to movement of the rear wheel.

In another aspect of embodiments described herein there is provided a method of cyclist training comprising use of a trainer device according to the present invention.

In another embodiment, the present invention includes at least one processor for monitoring or controlling use of the bicycle trainer. For example, the present invention may include a monitor to feed information, preferably in digital format, to the processor. Alternatively, or in addition, the present invention may include a controller for receiving commands from the processor to adjust operation of the bicycle trainer.

In a particularly preferred embodiment the processor is capable of communicating with external electronic devices such as mobile telephones and mobile computers. Communication may be achieved wirelessly, or through a wired connection such as a USB connector. This provides the option of having one or more applications (apps) to control or monitor or store information relating to use of the bicycle trainer.

Other aspects and preferred forms are disclosed in the specification and/or defined in the appended claims, forming a part of the description of the invention.

In essence, embodiments of the present invention stem from the realization that the use of a biased, pivot mounted belt to contact the rear wheel of a bicycle overcomes or alleviates many of the problems of trainers of the prior art.

Advantages provided by the present invention comprise the following:

a preset constant belt tension so that the bicycle rear wheel is never overloaded, preset belt tension can be readily changed, can support low speed/high load or high speed/low load motion, suitable for bench assembly, simplifying manufacture and servicing, fewer components compared to bicycle trainers of the prior art, capability for self adjustment to various wheel sizes or tyre shapes including knobby tyres, and reduces wear and maintenance needs on bicycle wheels and tyres.

Further scope of applicability of embodiments of the present invention will become apparent from the detailed description given hereinafter. However, it should be understood that the detailed description and specific examples, while indicating preferred embodiments of the invention, are given by way of illustration only, since various changes and modifications within the spirit and scope of the disclosure herein will become apparent to those skilled in the art from this detailed description.

BRIEF DESCRIPTION OF THE DRAWINGS

Further disclosure, objects, advantages and aspects of preferred and other embodiments of the present application may be better understood by those skilled in the relevant art by reference to the following description of embodiments taken in conjunction with the accompanying drawings, which are given by way of illustration only, and thus are not limitative of the disclosure herein, and in which:

FIG. 5 illustrates the bicycle trainer of FIG. 4 in the 'in use' position (with the wheel removed to give a clearer view).

FIG. 6 illustrates midline cross sections through the bicycle trainer of FIG. 5.

FIG. 7 illustrates a sectional side view in cross section of one embodiment of a roller and belt assembly of the bicycle trainer of the present invention.

DETAILED DESCRIPTION

Figure 1:
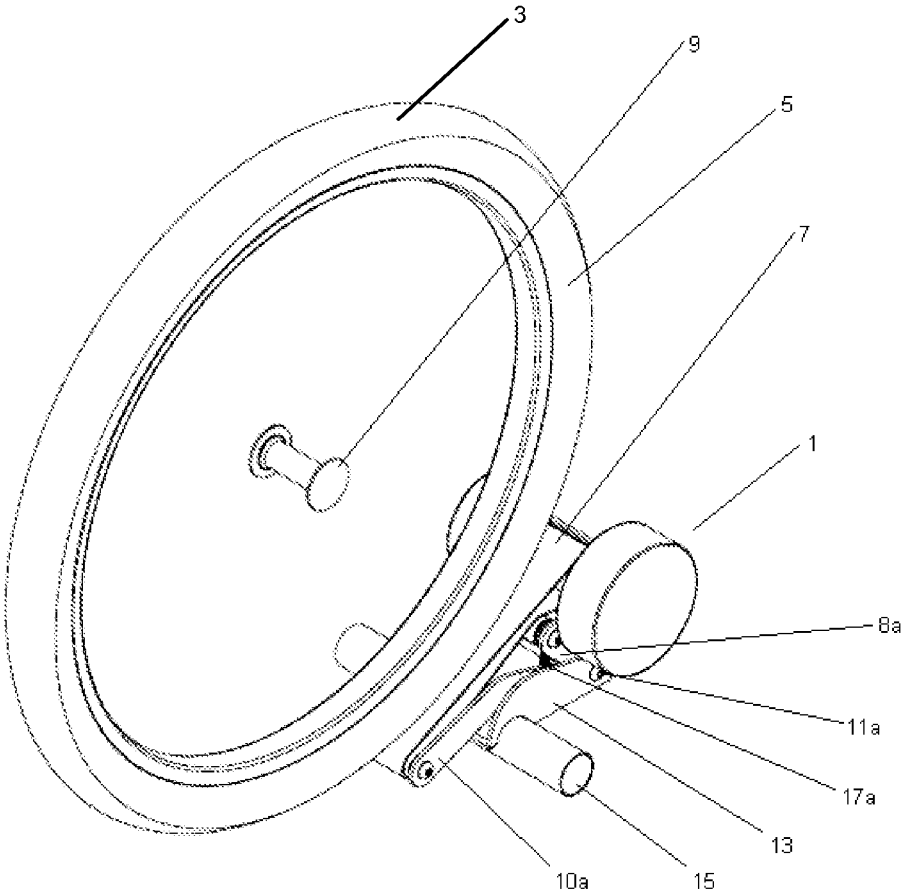
FIG. 1 illustrates a bicycle trainer according to one embodiment of the present invention showing the positioning of the pivot mounted belt relative to the rear wheel of a bicycle (with the stand omitted to provide a clearer view of the position of the wheel relative to the belt)

FIG. 1 illustrates a bicycle trainer (1) according to one embodiment of the present invention. In this drawing the rear wheel (3) of a bicycle is shown in the normal 'in use' position with the tyre (5) in contact with the belt (7) of the bicycle trainer (1). Typically the hub (9) of the wheel (3) is supported on a spindle which is attached at either end to a stand. In this view most of the stand has been omitted to provide a clearer view of the wheel (3) and the belt (7).

The bicycle trainer (1) comprises a rubberised belt (7) mounted on upper pivot arms (8*a*,8*b*) and lower pivot arms (10*a*, 10*b*) which move about pivots (11*a*,11*b*) in a mounting bracket (13). The mounting bracket (13) is contoured to fit the base member (15) of a stand. The pivoting movement of the pivot arms (10*a*, 10*b*) is subject to the effect of biasing means (17*a*,17*b*) in the form of coiled springs. The frictional contact between the wheel (3) and the belt (7) is sufficient to cause the belt (7) to move in response to rotation of the wheel (3). The biasing by the springs (17*a*,17*b*) provides a constant belt tension so that the wheel (3) is never overloaded irrespective of variations in pressure and contact between the tyre (5) and belt (7). Furthermore, the movability of the belt (7) about the pivot (11*a*,11*b*) allows self adjustment to various wheel shapes and sizes.

Figure 2A:
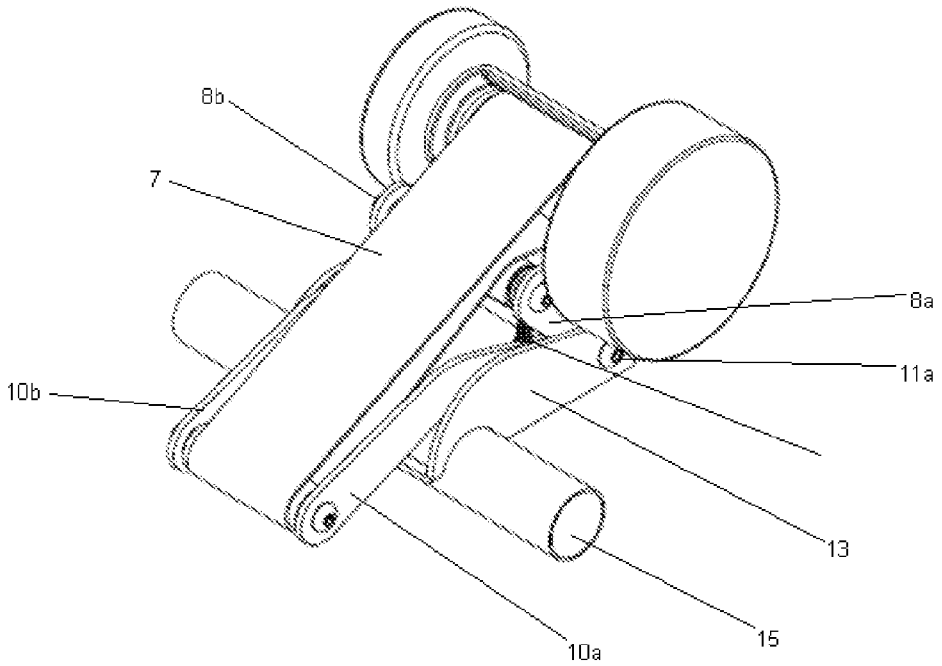
FIG. 2 illustrates the bicycle trainer of FIG. 1 in a first, raised position (FIG. 2*a*) and a second, lower position (FIG. 2*b*) to show the pivotal movement of the belt.
Figure 2B:
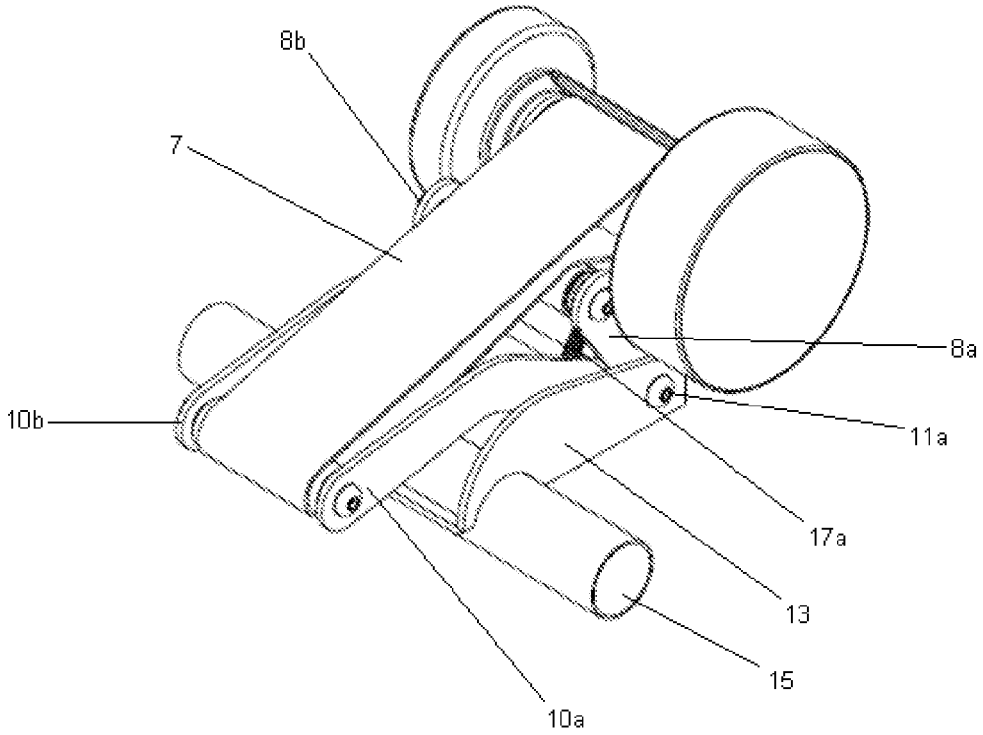

FIG. 2 illustrates the bicycle trainer (1) of FIG. 1 with the belt (7) in a first, raised position (FIG. 2*a*) and a second, lower position (FIG. 2*b*) as the upper pivot arms (8*a*,8*b*) and lower pivot arms (10*a*, 10*b*) are moved between the two positions. This movement can occur in response to pressure imparted by the wheel during rotation, changing to a wheel of different size or differing contours or shapes of tyres.

Figure 3:
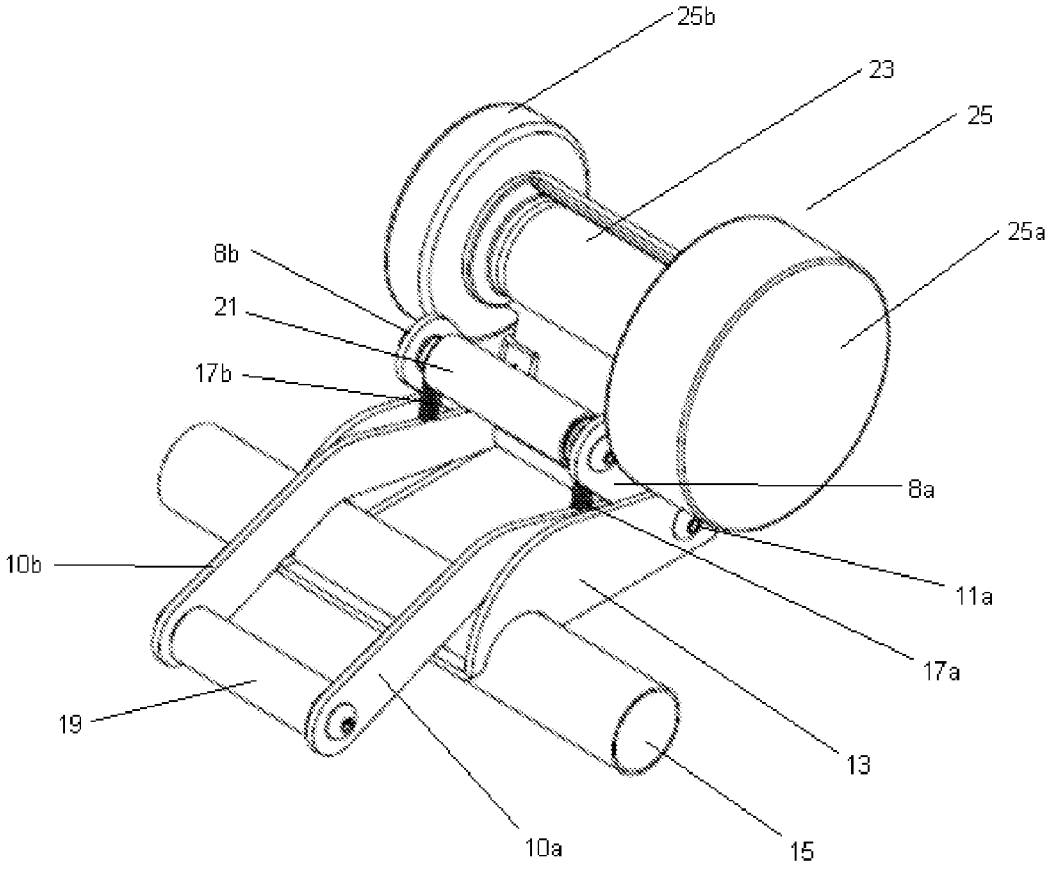
FIG. 3_illustrates the bicycle trainer as shown in FIG. 2*b* with the belt omitted to provide a clearer view of the mechanism.

FIG. 3 illustrates the bicycle trainer as shown in FIG. 2*b* with the belt (7) omitted to provide a clearer view of the supporting mechanism. The belt (7) is a continuous band of rubberised material looped around three rollers (19,21,23) located between the lower pivot arms (10*a*, 10*b*), between the upper pivot arms (8*a*,8*b*) and as part of the resistance means (25). The resistance means (25) comprises an adjustable drum brake (25*a*) and flywheel (25*b*) at either end of the roller (23). The resistance means (25) can be used to pre-set the resistance to rotation of the wheel (3). For example a cable or similar device can be used to set the resistance of the drum brake. In another embodiment a cable could be used to set a magnetic resistance device used as a resistance means.

The rubberised material is sufficiently flexible that it at least partly adapts to the cross-sectional profile of the tyre (5) of the wheel to spread out the force and wear on the tyre (5). The device of the present invention is sufficiently simple that it can be set up square on to the tyre (5), avoiding run-out of the belt (7).

Figure 4:
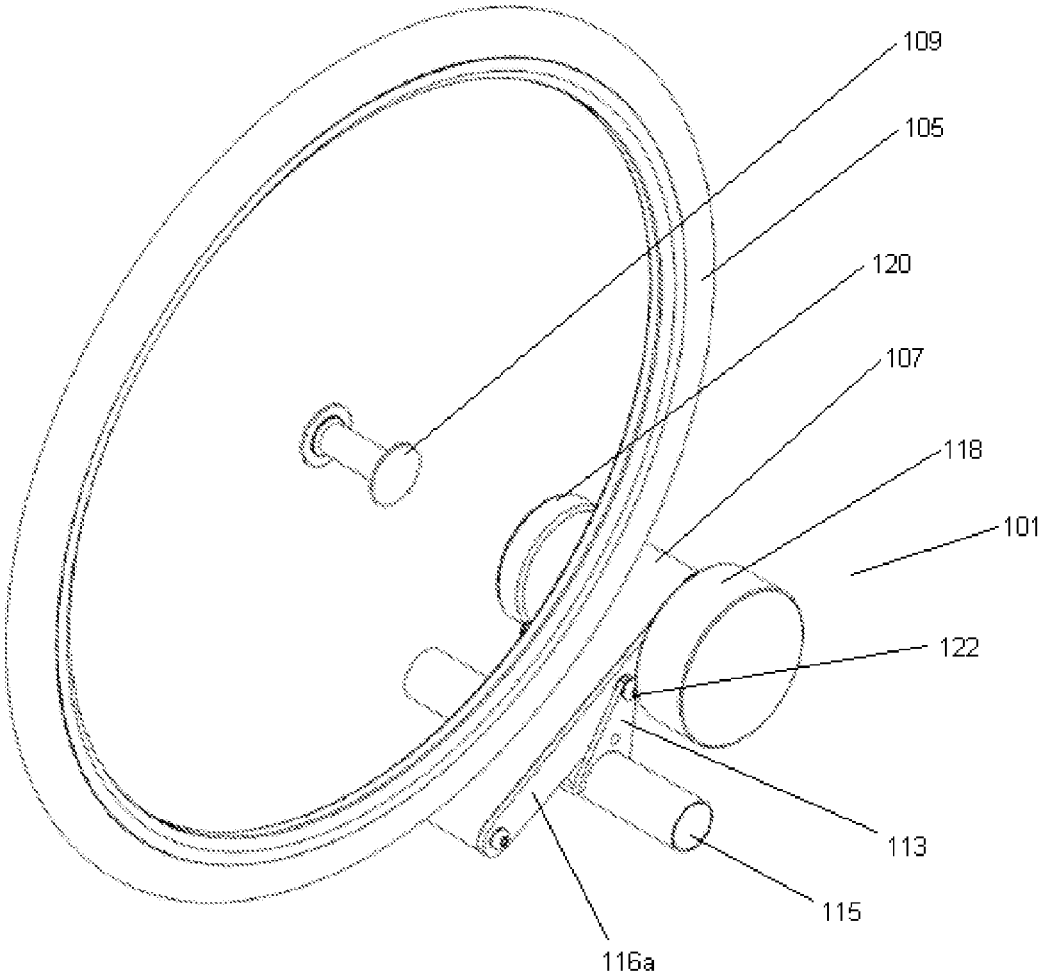
FIG. 4 illustrates a bicycle trainer according to a further embodiment of the present invention and shows its position relative to the rear wheel of a bicycle when in use.
Figure 5A:
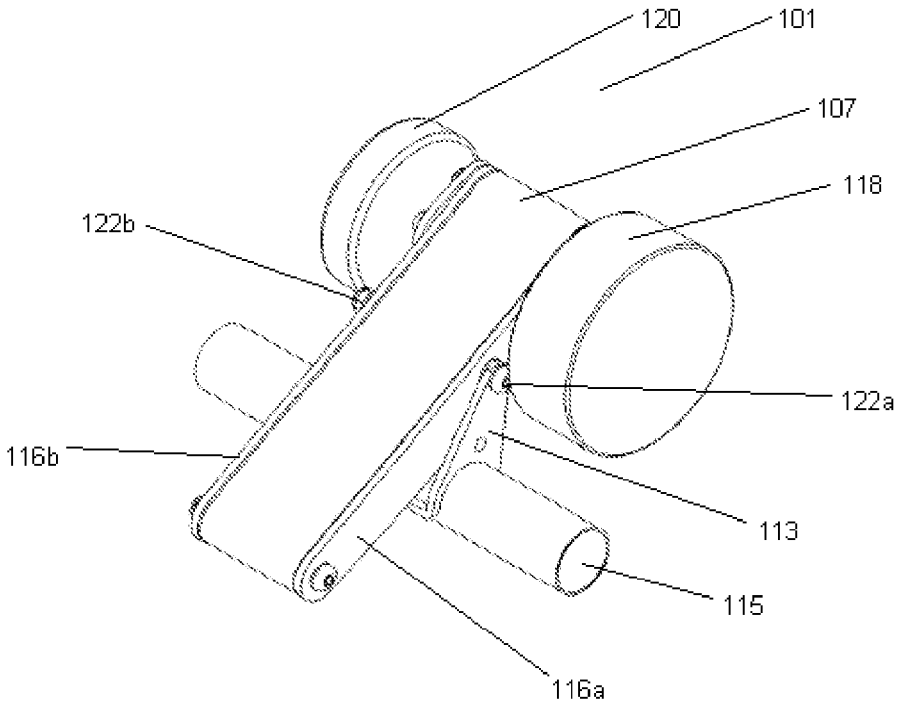
FIG. 5*a* shows the 'in use' conformation of the bicycle trainer with the belt pressing against a wheel.
Figure 5B:
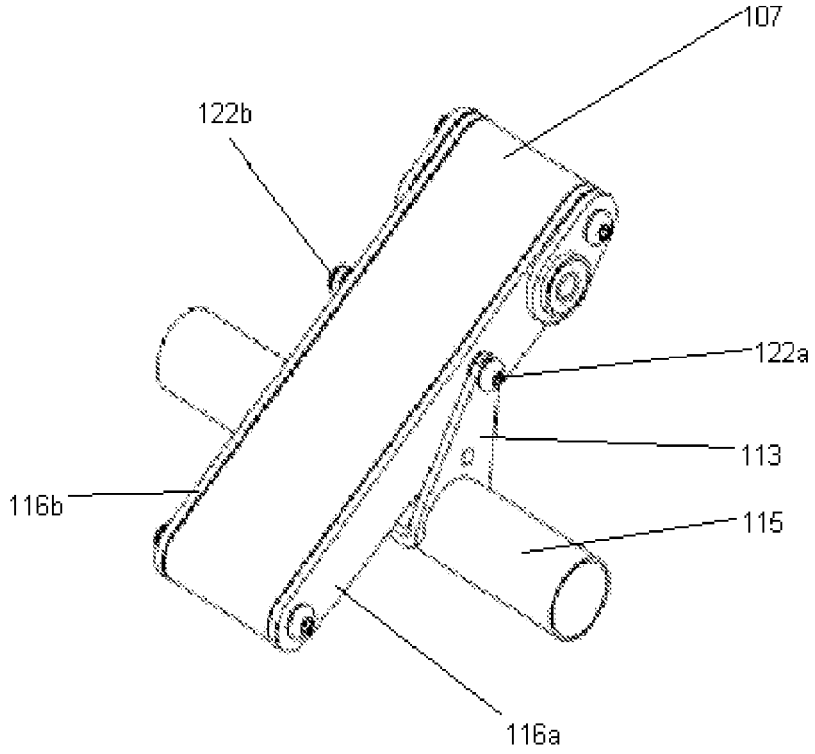
FIG. 5*b* is the same as the view shown in FIG. 5*a* but with the magneto of the bicycle trainer removed to give a clearer view.
Figure 5C:
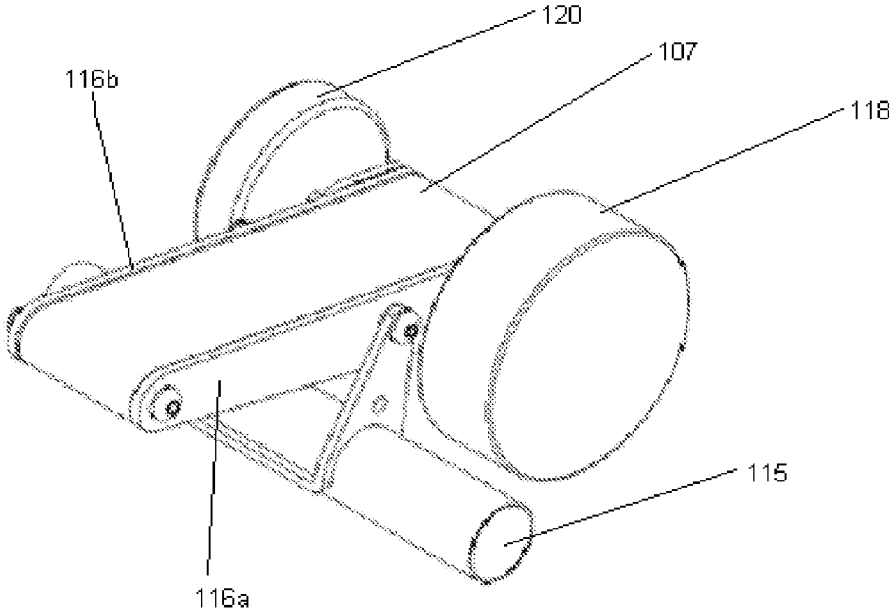
FIG. 5*c* shows the 'at rest' conformation of the bicycle trainer when the belt is no longer in contact with a wheel.
Figure 5D:
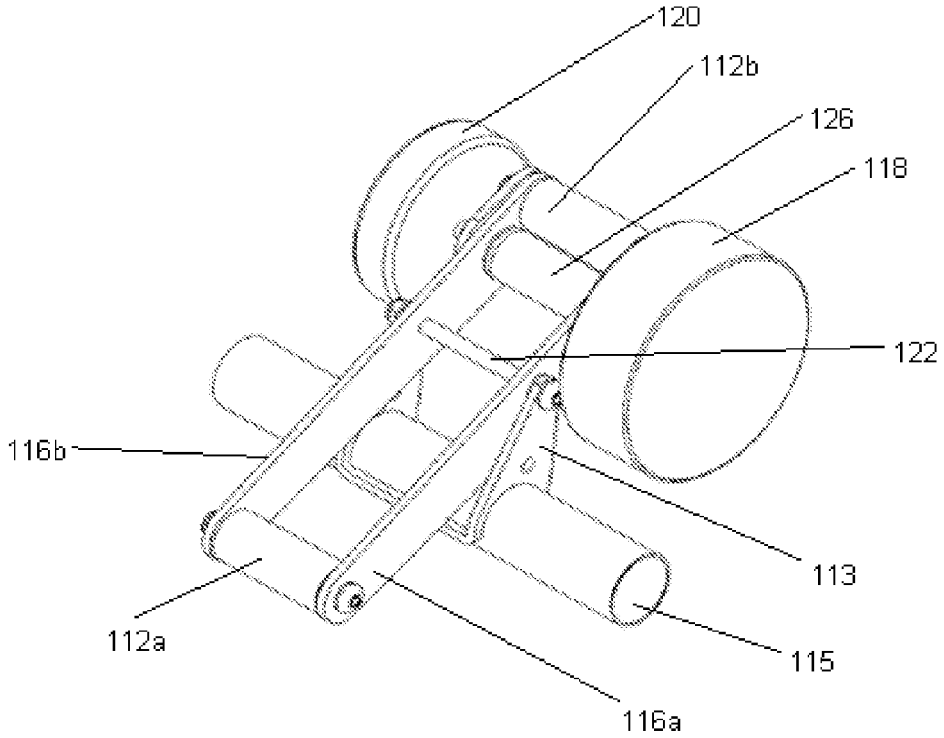
FIG. 5*d* illustrates the bicycle trainer of FIG. 5*a* as if it were in the 'in use' position, pressing against a wheel, but with the wheel and belt removed to give a clearer view of the relationship of the rollers and pinion.

FIG. 4 illustrates a bicycle trainer (101) according to one embodiment of the present invention showing its position relative to the rear wheel of a bicycle when in use. In this drawing the rear wheel (103) of a bicycle is shown in the normal 'in use' position with the tyre (105) in contact with the belt (107) of the bicycle trainer (101). Typically the hub (109) of the wheel (103) is supported on a spindle which is attached at either end to a stand. In this view, most of the stand has been omitted to provide a clearer view of the wheel (103) and the belt (107).

The bicycle trainer (101) comprises a rubberised belt (107) which passes around a front roller and a rear roller (112*a*, 112*b*—not shown in this view) mounted at either end of a pair of pivot arms (116*a*, 116*b*). A rear shaft (126—not shown in this view) is supported on the pivot arms (116*a*, 116*b*). The upper roller (112*a*) is attached at one end to a magneto (118) and at the other end to a flywheel (120). The mounting bracket (113) is contoured to fit the base member (115) of a stand. A middle pinion (122) rotatably attached at either end (122*a*,122*b*) to the mounting bracket (113) is located at the fulcrum of the pivot arm (116). In the 'in use' position depicted the wheel (103) causes the pivot arm (116) to pivot downwards about the middle pinion (122). When the wheel (103) is removed, the weight of the magneto (118) and flywheel (120) cause the pivot arm (116) to rotate about the fulcrum in the other direction. (Accordingly, in contrast to the embodiment shown in FIGS. 1 to 3, the embodiment shown in FIGS. 4 to 7 does not require a biasing means). The frictional contact between the wheel (103) and the belt (107) is sufficient to cause the belt (107) to move in response to rotation of the wheel (103).

FIG. 5 illustrates the bicycle trainer (101) of FIG. 4 (with the wheel (103) removed to give a clearer view). FIG. 5*a* shows the 'in use' conformation of the bicycle trainer (101), pressed against the wheel (103). FIG. 5*b* is the same as the view shown in FIG. 5*a* but with the magneto (118) and flywheel (120) removed to give a clearer view of the magneto mount which carries bearings for the magneto (120) and can rotate around the shaft of the rear roller (112*b*—not shown). FIG. 5*c* shows the conformation of the bicycle trainer (101) when not in use, removed from contact with a wheel. When the wheel is removed, the mass of the magneto (118) and flywheel (120) causes the assembly to rotate around the pinion (122) into the 'rest' position as illustrated. FIG. 5*d* illustrates the bicycle trainer (101) of FIG. 5*a* as if it were in position, pressing against a wheel, with the wheel and belt removed to give a clearer view of the relative positions of the front roller (112*a*) and rear roller (112*b*) and pinion (122).

Figure 6A:
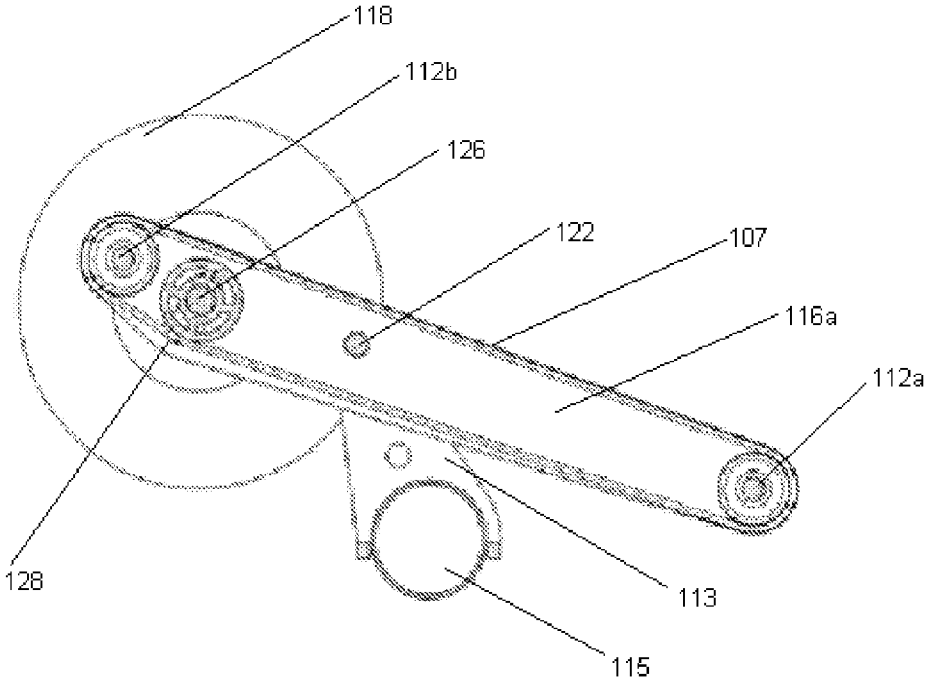
FIG. 6*a* shows the bicycle trainer in the 'in use' position, pressing against a wheel.
Figure 6B:
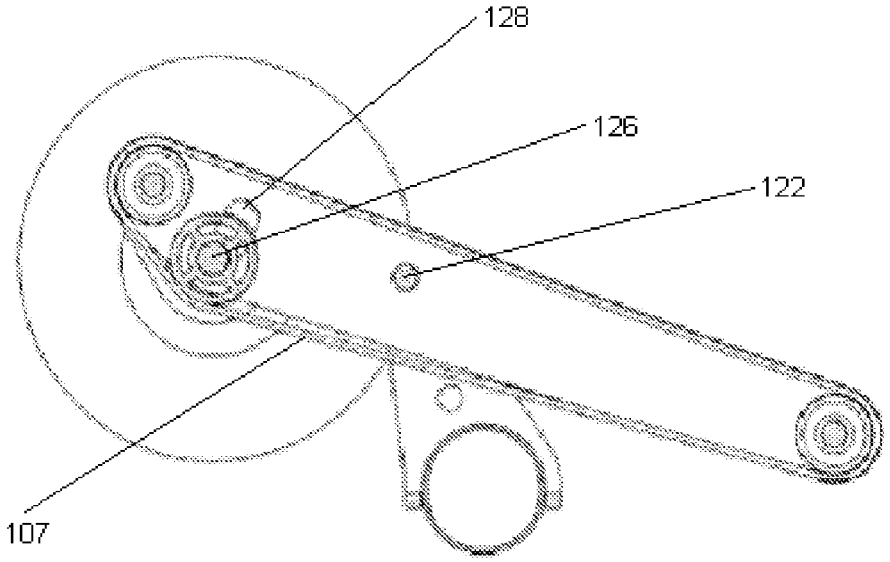
FIG. 6*b* shows the bicycle trainer of FIG. 6*a* pressing more firmly against the wheel such that the belt has become slightly longer and the magneto has rotated around the rear shaft to maintain tension on the belt.
Figure 6C:
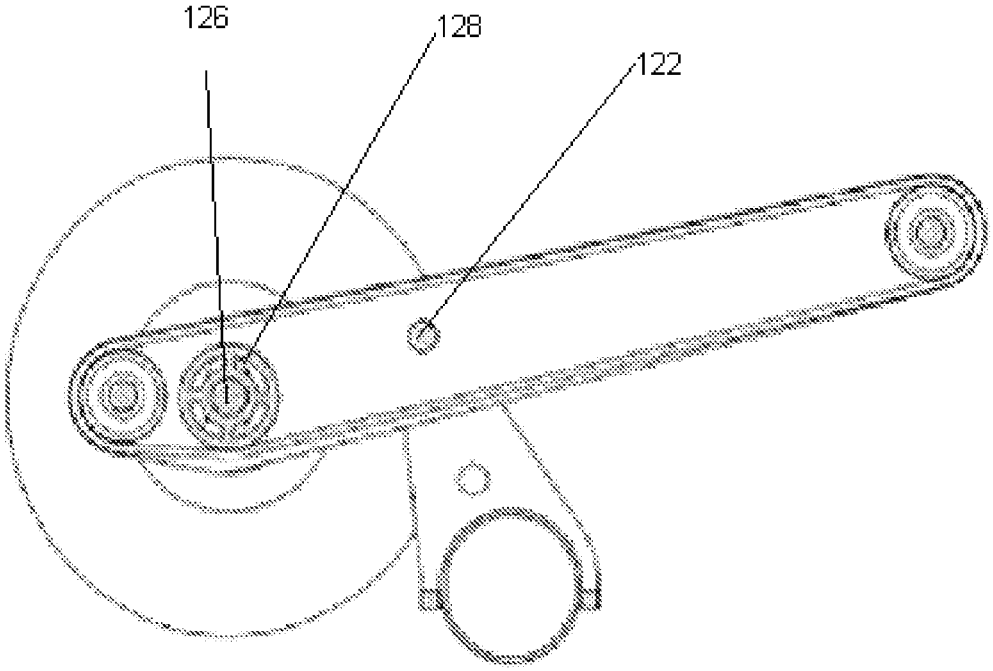
FIG. 6*c* shows the bicycle trainer of FIG. 6*a* rotated around the pinion to the 'at rest' position.

FIG. 6 illustrates midline cross sections through the bicycle trainer (101) of FIG. 5. In this view it can be seen that the rear shaft (126) can move within a recess (128) in the pivot arm (116*a*). Specifically, FIG. 6*a* shows the bicycle trainer (101) in the 'in use' position as if it were pressing against a wheel (not shown). FIG. 6*b* shows the bicycle trainer (101) of FIG. 6*a*, but pressing more firmly against the wheel. The pressure has caused the magneto (118) and rear shaft (126) to move in the recess (128) in the pivot arm (116*a*) causing the belt (107) to become slightly stretched. Thus, a constant belt tension is maintained and the wheel is never overloaded irrespective of variations in pressure and contact between the tyre and belt (107). Furthermore, the movability of the belt (107) about the pinion (122) allows self adjustment to various wheel shapes and sizes. FIG. 6*c* shows the bicycle trainer (101) of FIG. 6*a* after the wheel has been removed and the weight of the magneto (118) has caused the pivot arm (116*a*) to rotate about the pinion to the 'rest' position.

Figure 7A:
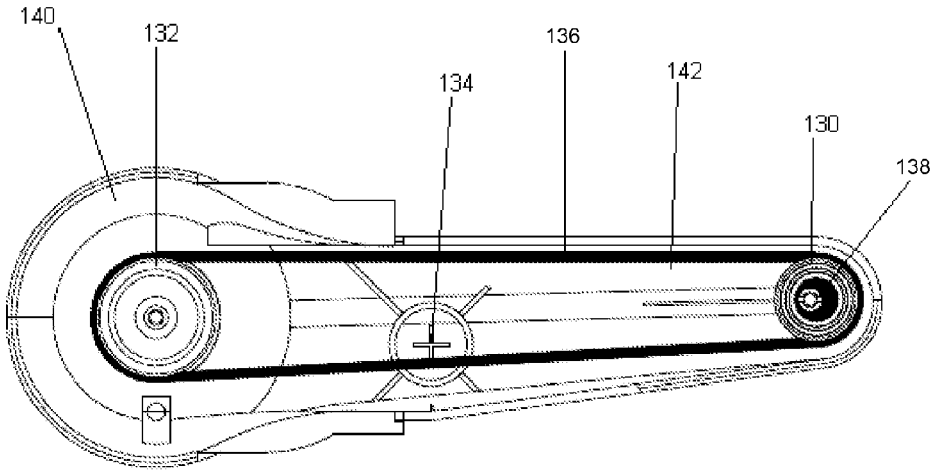
FIG. 7*a* shows the belt fully tensioned and FIG. 7*b* shows the eccentric roller adjusted to release tension on the belt.
Figure 7B:
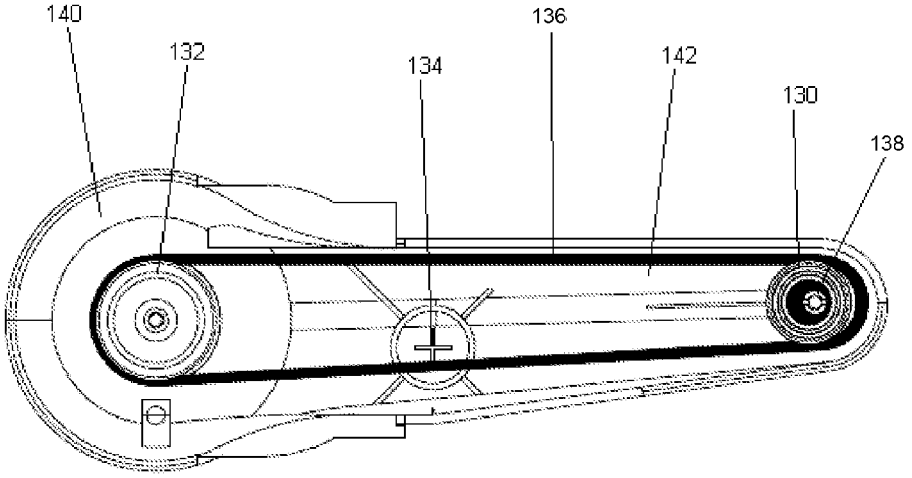

FIG. 7 illustrates a plan view in cross section of one embodiment of the roller and belt assembly of the bicycle trainer of the present invention comprising a front roller (130) and a rear roller (132) encircled by a belt (136), and a pinion (134) between the front roller (130) and rear roller (132). The front roller (130) has an eccentrically located shaft (138). FIG. 7*a* shows the shaft (138) located such that the separation of the rollers is maximized and the belt (136) is fully tensioned. FIG. 7*b* shows the eccentric shaft (138) adjusted by turning a fixing screw to slightly reduce the separation of the rollers and release tension on the belt (136). This allows the belt (136) to be loaded or unloaded from the rollers (130, 132).

With reference to FIG. 7 it is also clear that the bicycle trainer can be readily assembled on a bench. Specifically, once the magneto (140) and pivot arm (142) are connected, the front roller (130) and rear roller (132) can be put in the position shown in FIG. 7(*b*). The belt (136) can then be placed around the de-tensioned rollers (130, 132) before the eccentric shaft (136) is adjusted by turning a fixing screw to increase the separation between the rollers (130,132) to fully tensioned the belt (136) as shown in FIG. 7(*a*). This assembly can all be carried out with the bicycle trainer on its side as shown in FIG. 7 without the need to access the assembly from the other side, or any another angle.

While this invention has been described in connection with specific embodiments thereof, it will be understood that it is capable of further modification(s). This application is intended to cover any variations uses or adaptations of the invention following in general, the principles of the invention and including such departures from the present disclosure as come within known or customary practice within the art to which the invention pertains and as may be applied to the essential features hereinbefore set forth.

As the present invention may be embodied in several forms without departing from the spirit of the essential characteristics of the invention, it should be understood that the above described embodiments are not to limit the present invention unless otherwise specified, but rather should be construed broadly within the spirit and scope of the invention as defined in the appended claims. The described embodiments are to be considered in all respects as illustrative only and not restrictive.

Various modifications and equivalent arrangements are intended to be included within the spirit and scope of the invention and appended claims. Therefore, the specific embodiments are to be understood to be illustrative of the many ways in which the principles of the present invention may be practiced. In the following claims, means-plus-function clauses are intended to cover structures as performing the defined function and not only structural equivalents, but also equivalent structures.

"Comprises/comprising" and "includes/including" when used in this specification is taken to specify the presence of stated features, integers, steps or components but does not preclude the presence or addition of one or more other features, integers, steps, components or groups thereof. Thus, unless the context clearly requires otherwise, throughout the description and the claims, the words 'comprise', 'comprising', 'includes', 'including' and the like are to be construed in an inclusive sense as opposed to an exclusive or exhaustive sense; that is to say, in the sense of "including, but not limited to".

The invention claimed is:

1. A bicycle trainer, the bicycle trainer comprising:

a biased, pivot mounted belt for contact with a rear wheel of a bicycle at a contact surface, such that the belt moves in response to a rotation of the rear wheel, the belt corresponding in size to the contact surface of the rear wheel of the bicycle and bearing a load of the wheel;

a first roller mounted at one end of a pair of pivot arms, and a second roller mounted at another end of the pair of pivot arms, wherein the pivot arms are supported by a mounting bracket adapted to fit a stand, wherein the pair of pivot arms are configured to pivot about a pinion rotatably attached to an end of the mounting bracket opposite the stand located at a fulcrum on the pivot arms between the first roller and the second roller, and the first roller and second roller being mounted to the pair of pivot arms are and configured to move with the pair of pivot arms, wherein the belt is looped around the first roller and the second roller.

2. The bicycle trainer according to claim 1, wherein the first roller is an eccentric roller that is adjustable to provide a predetermined tension.

3. The bicycle trainer according to claim 2, wherein the predetermined tension is adapted to be changed.

4. The bicycle trainer according to claim 2, wherein the predetermined tension is substantially constant tension.

5. The bicycle trainer according to claim 1, wherein the belt is subjected to a stretching force in response to increasing the pressure exerted by the rear wheel in contact with the belt.

6. The bicycle trainer according to claim 5, wherein changing pressure exerted by the rear wheel causes a shaft to move within in a recess associated with a pivot arm of the pair of pivot arms.

7. A method of assembling a bicycle trainer according to claim 1, the method comprising the steps of:

connecting a magneto and the pair of pivot arms, locating the first roller and the second roller at either end of the pair of pivot arm, placing the belt around the rollers, and tensioning the belt to a predetermined tension.

8. The method according to claim 7, wherein the first roller is an eccentric roller and adjustment of said eccentric roller tensions the belt.

9. The bicycle trainer according to claim 1, wherein a predetermined tension is changed by altering the distance between the first and second rollers.

10. The bicycle trainer according to claim 1, wherein the belt at least partially conforms to the cross-sectional profile of the rear wheel.

11. The bicycle trainer according to claim 1, wherein the belt moves about a pivot mount to automatically adjust to a surface of the wheel.

12. The bicycle trainer according to claim 1, wherein one end of the first roller is associated with a magneto and the other end of the first roller is associated with a flywheel.

13. The bicycle trainer according to claim 1, wherein the pivot is biased by a spring, a weights or combinations thereof.

14. The bicycle trainer according to claim 1 including a resistance device for controlling resistance of the belt to movement of the rear wheel.

15. The bicycle trainer according to claim 1, wherein the pivot mounted belt moves from a first 'at rest' position to a second 'in use' position in response to contact of the bicycle rear wheel on the belt.

16. A method of cyclist training comprising the step of contacting the rear wheel of a bicycle with the belt of a trainer device according to claim 1.

17. A bicycle trainer, the bicycle trainer comprising:

a biased, pivot mounted belt for contact with a rear wheel of a bicycle at a contact surface, such that the belt moves in response to a rotation of the rear wheel, the belt corresponding to the cross-sectional profile of the contact surface when in contact with the rear wheel and bearing a load of the rear wheel;

a first roller mounted at one end of a pair of pivot arms, and a second roller mounted at another end of the pair of pivot arms, wherein the pivot arms are supported by a mounting bracket adapted to fit a stand, wherein the pair of pivot arms are configured to pivot about a pinion rotatably attached to an end of the mounting bracket opposite the stand located at a fulcrum on the pivot arms between the first roller and the second roller, the first roller and second roller being mounted to the pair of pivot arms and configured to move with the pair of pivot arms, wherein the belt is looped around the first roller and the second roller and at least partially conforms to the cross-sectional profile of the rear wheel and automatically adjusts to rear wheel characteristics.

18. A bicycle trainer according to claim 1 wherein application of the rear wheel to the belt provides tension without the need for a secondary tensioning device.

* * * * *